US008085019B2

(12) United States Patent
Cho et al.

(10) Patent No.: US 8,085,019 B2
(45) Date of Patent: Dec. 27, 2011

(54) DEVICE FOR GENERATING INTERNAL POWER SUPPLY VOLTAGE AND METHOD THEREOF

(75) Inventors: Jong-Pil Cho, Seoul (KR); Chan-Yong Kim, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 611 days.

(21) Appl. No.: 11/976,006

(22) Filed: Oct. 19, 2007

(65) Prior Publication Data

US 2008/0186003 A1 Aug. 7, 2008

(30) Foreign Application Priority Data

Oct. 20, 2006 (KR) ..... 10-2006-0102401

(51) Int. Cl.
*G05F 1/56* (2006.01)

(52) U.S. Cl. ..... 323/281; 323/901; 323/314

(58) Field of Classification Search ..... 323/314, 323/281, 901, 317, 313, 316; 327/539
See application file for complete search history.

(56) References Cited

U.S. PATENT DOCUMENTS

| | | | | |
|---|---|---|---|---|
| 5,867,013 | A | 2/1999 | Yu | |
| 6,683,445 | B2 * | 1/2004 | Park | 323/315 |
| 6,806,764 | B2 | 10/2004 | Inagaki et al. | |
| 7,286,002 | B1 * | 10/2007 | Jackson | 327/539 |
| 7,301,318 | B2 * | 11/2007 | Haider et al. | 323/282 |
| 2006/0061346 | A1 * | 3/2006 | Lee et al. | 323/313 |

FOREIGN PATENT DOCUMENTS

| | | |
|---|---|---|
| JP | 2005-135112 | 5/2005 |
| KR | 1020000000932 | 1/2000 |
| KR | 2002-0024914 | 4/2002 |
| KR | 2003-0054216 | 7/2003 |
| KR | 10-0400383 | 9/2003 |
| KR | 2004-0011790 | 2/2004 |

* cited by examiner

*Primary Examiner* — Harry Behm
(74) *Attorney, Agent, or Firm* — Harness, Dickey & Pierce, P.L.C.

(57) ABSTRACT

Example embodiments relate to an internal power supply voltage generating device. The internal power supply voltage generating device may include a start-up voltage generating part, a reference voltage generating part, and/or an internal power supply voltage generating part. The start-up voltage generating part may be configured to generate a start-up voltage using an external power supply voltage. The reference voltage generating part may be configured to generate a reference voltage using the start-up voltage. The internal power supply voltage generating part may be configured to generate an internal power supply voltage using the reference voltage and the external power supply voltage. The start-up voltage generating part may be turned off by the reference voltage generated by the reference voltage generating part. Example embodiments also relate to a method of generating an internal power supply voltage.

15 Claims, 5 Drawing Sheets

DEVICE FOR GENERATING INTERNAL POWER SUPPLY VOLTAGE AND METHOD THEREOF

PRIORITY STATEMENT

This application claims priority under 35 U.S.C. §119 of Korean Patent Application 2006-102401, filed on Dec. 20, 2006, in the Korean Patent Office, the entire contents of which are incorporated herein by reference.

BACKGROUND

Recently, with lower powering of systems and miniaturization of semiconductor processes, supply voltages (hereinafter, referred to as external power supply voltages) of chips have gone to lower voltage levels. However, it is difficult for all chips to go to a lower voltage at the same time. Thus, reducing the power of overall systems often lags behind that of single chips, and there coexist systems that may supply different external power supply voltages. Accordingly, chips may be equipped with a voltage converting device that generates a constant internal power supply voltage regardless of different external power supply voltages. As this voltage converting device may be located in a chip, it may be possible to apply the same chip to systems that supply different external power supply voltages.

FIG. 1 is a block diagram showing a conventional internal power supply voltage generating device.

Referring to FIG. 1, a conventional internal power supply voltage may have a reference voltage generating part 10 for generating a reference voltage VREF using an external power supply voltage VDD_EXT, and an internal power supply voltage generating part 11.

The reference voltage generating part 10 and the internal power supply voltage generating part 11 may be supplied with an external voltage, for example, an external power supply voltage VDD_EXT, as an operating voltage. The reference voltage generating part 10 may be a band-gap reference (BGR) circuit that is well known in the art, for example.

When the external power supply voltage VDD_EXT is supplied to a chip, the reference voltage generating part 10 may generate a reference voltage VREF, and the internal power supply voltage generating part 11 may convert the external power supply voltage VDD_EXT into an internal power supply voltage VDD_INT based on the reference voltage VREF. The internal power supply voltage VDD_INT may be generated as described below.

The internal power supply voltage generating part 11 may receive the external power supply voltage VDD_EXT, and generate the internal power supply voltage VDD_INT of a given level based on the reference voltage VREF generated in an integrated circuit device. Because the internal power supply voltage generating part 11 may generate the internal power supply voltage VDD_INT using the reference voltage VREF, the reference voltage generating part 10 may use the external power supply voltage VDD_EXT as its operating voltage.

The external power supply voltage VDD_EXT may be different based on which systems the semiconductor integrated circuit devices are applied. While the external power supply voltage VDD_EXT may be varied within a wide voltage range, the reference voltage, which is essentially constant regardless of variation in the external power supply voltage, enables a constant internal power supply voltage VDD_INT to be obtained. But, the following problem may arise from a semiconductor integrated circuit device adopting an internal power supply voltage generating device illustrated in FIG. 1.

When an internal power supply voltage generating device illustrated in FIG. 1 is applied to a system, an internal power supply voltage VDD_INT and a reference voltage VREF may need to be maintained at a constant level regardless of a voltage (for example, an external power supply voltage) supplied from the system. In order to maintain the internal power supply voltage VDD_INT, the reference voltage VREF may have to be maintained constant regardless of variation of the external power supply voltage VDD_EXT, or at least within a voltage range where the external power supply voltage may be varied.

For example, consider a system where external power supply voltages of 5V, 3V and 1.8V are all supported. For an operating margin, the reference voltage generating part 10 may be provided to stably operate at an external power supply voltage within a voltage range between 1.5V and 5V, and to generate a constant reference voltage. Where a stable operation of the reference voltage generating part 10 is not secured within a voltage range of the external power supply voltage VDD_EXT, it may be difficult or impossible to maintain the reference voltage constant in a lower operating voltage range and in a higher operating voltage range. Thus, the reference voltage VREF may be varied at a lower operating voltage range and/or at a higher operating voltage range, and the internal power supply voltage VDD_INT may not be maintained constant.

Accordingly, because a semiconductor integrated circuit device including the reference voltage generating part 10 may be applied to many systems, a stable operation of the reference voltage generating part 10 may need to be secured within a relatively wide voltage range.

FIG. 2 is a block diagram showing another conventional internal power supply voltage generating device.

Referring to FIG. 2, an internal power supply voltage generating device may include a reference voltage generating part 20 for generating a reference voltage VREF using an internal power supply voltage VDD_INT feedback, and an internal power supply voltage generating part 21 for generating the internal power supply voltage VDD_INT using the reference voltage VREF.

Unlike the internal power supply voltage generating device illustrated in FIG. 1, the reference voltage generating part 20 illustrated in FIG. 2 may use the internal power supply voltage VDD_INT instead of an external power supply voltage as its operating voltage, where the internal power supply voltage generating part 21 may use the external power supply voltage as its operating voltage.

The above-described problem of the device illustrated in FIG. 1 is addressed by the device illustrated in FIG. 2, but problems may arise relating to start-up of the reference voltage generating part 20 and the internal power supply voltage generating part 21.

For example, at start-up, the internal power supply voltage generating part 21 may generate the internal power supply voltage VDD_INT by generating the reference voltage VREF via the reference voltage generating part 20 and generating the internal power supply voltage VDD_INT based on the reference voltage VREF. It may be difficult or impossible to secure a normal operation of the reference voltage generating part 20 at a start-up point in time when the internal power supply voltage VDD_INT is not generated normally due to the above-described structural feedback characteristic. Accordingly, the internal power supply voltage generating part 21 may not generate the internal power supply voltage VDD_INT normally.

FIG. 3 is a timing diagram showing start-up of an internal power supply voltage generating device illustrated in FIG. 2.

As understood from FIG. 3, the internal power supply voltage VDD_INT may not be generated normally because of an abnormal start-up of the reference voltage generating part 20, though an external power supply voltage VDD_EXT is applied. In other words, an internal power supply voltage generating device illustrated in FIG. 2 may have the structure where an internal power supply voltage VDD_INT is used as an operating voltage of a reference voltage generating part 20 and an internal power supply voltage generating part 21 generates the internal power supply voltage VDD_INT using a reference voltage VREF. Accordingly, it may be difficult to generate a reference voltage VREF having a given level via the reference voltage generating part 20 illustrated in FIG. 2. Therefore, the internal power supply voltage VDD_INT may not have a required level.

SUMMARY

Example embodiments relate to an internal power supply voltage generating device. The internal power supply voltage generating device may include a start-up voltage generating part, a reference voltage generating part, and/or an internal power supply voltage generating part. The start-up voltage generating part may be configured to generate a start-up voltage using an external power supply voltage. The reference voltage generating part may be configured to generate a reference voltage using the start-up voltage. The internal power supply voltage generating part may be configured to generate an internal power supply voltage using the reference voltage and the external power supply voltage. The start-up voltage generating part may be turned off by the reference voltage generated by the reference voltage generating part.

Example embodiments also relate to a method of generating an internal power supply voltage. The method may include generating a start-up voltage, generating a reference voltage, generating an internal power supply voltage, and/or feeding back the reference voltage. The start-up voltage may be generated using an external power supply voltage. The reference voltage may be generated using the start-up voltage. The internal power supply voltage may be generated in response to the reference voltage and the external power supply voltage. The reference voltage may be fed back to stop generating the start-up voltage.

BRIEF DESCRIPTION OF THE DRAWINGS

The above and other features and advantages of example embodiments will become more apparent by describing in detail example embodiments with reference to the attached drawings. The accompanying drawings are intended to depict example embodiments and should not be interpreted to limit the intended scope of the claims. The accompanying drawings are not to be considered as drawn to scale unless explicitly noted.

DESCRIPTION OF EXAMPLE EMBODIMENTS

Figure 1:
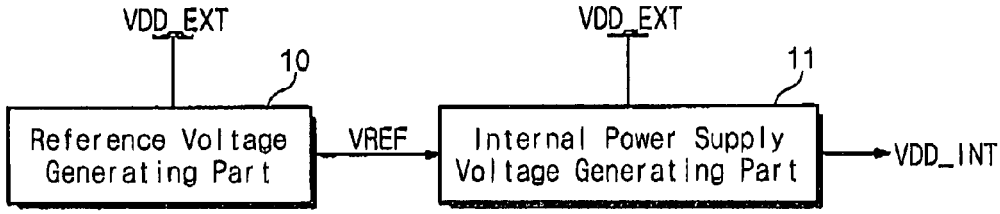
Fig. 1 (CONVENTIONAL ART)
FIG. 1 is a block diagram showing a conventional internal power supply voltage generating device.
Figure 2:
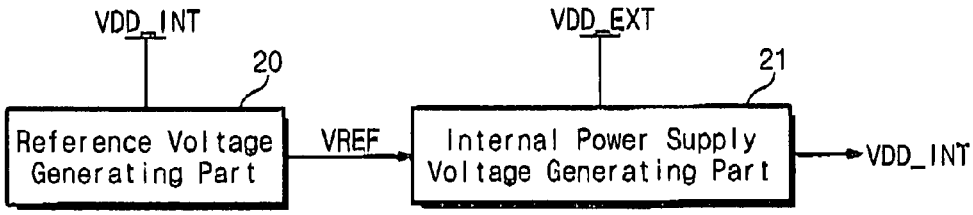
Fig. 2 (CONVENTIONAL ART)
FIG. 2 is a block diagram showing another conventional internal power supply voltage generating device.

Detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or directly coupled" to another element, there are not intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Figure 4:
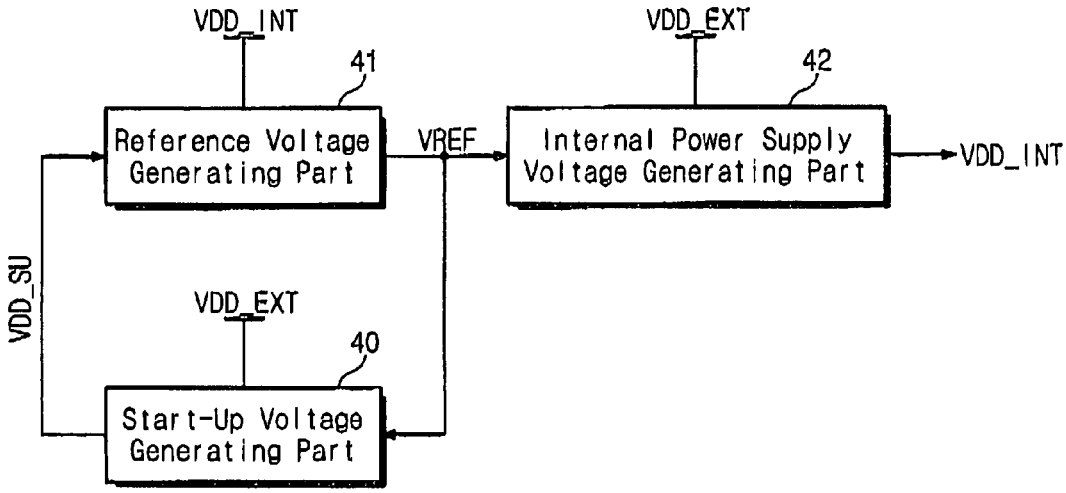
FIG. 4 is a block diagram illustrating an internal power supply voltage generating device according to an example embodiment.

FIG. 4 is a block diagram showing an internal power supply voltage generating device according to an example embodiment.

Referring to FIG. 4, an internal power supply voltage generating device may include a start-up voltage generating part 40 for generating a start-up voltage VDD_SU using an external power supply voltage VDD_EXT, a reference voltage generating part 41 for generating a reference voltage VREF using the start-up voltage VDD_SU, and an internal power supply voltage generating part 42 for generating an internal power supply voltage VDD_INT.

The start-up voltage generating part 40 may generate the start-up voltage VDD_SU using the external power supply voltage VDD_EXT and supply the start-up voltage VDD_SU to the reference voltage generating part 41 as a driving voltage at start-up or power-up. The reference voltage generating part 41 may be driven by the start-up voltage VDD_SU at start-up and generate the reference voltage VREF. At start-up, the start-up voltage generating part 40 may be supplied with the reference voltage via a feedback loop and be turned off when the reference voltage having a required level is received.

The reference voltage generating part 41 may be driven by the internal power supply voltage VDD_INT from the internal power supply voltage generating part 42 after an initial operation at power-up.

When the external power supply voltage VDD_EXT is initially applied to the device, the start-up voltage generating part 40 may use the external power supply voltage VDD_EXT to generate a start-up voltage VDD_SU of more than approximately 2*Vth, where Vth is a threshold voltage. The start-up voltage VDD_SU may be provided to the reference voltage generating part 41 as its operating voltage.

The start-up voltage generating part 40 may operate primarily when the external power supply voltage VDD_EXT is initially applied to the device, for example, at initial power-up. The start-up voltage generating part 40 may start up the reference voltage generating part 41, and be disabled through feedback control of the reference voltage VREF. For this reason, the start-up voltage generating part 40 may not affect the power level of the internal power supply voltage VDD_INT generated after start-up.

Figure 5:
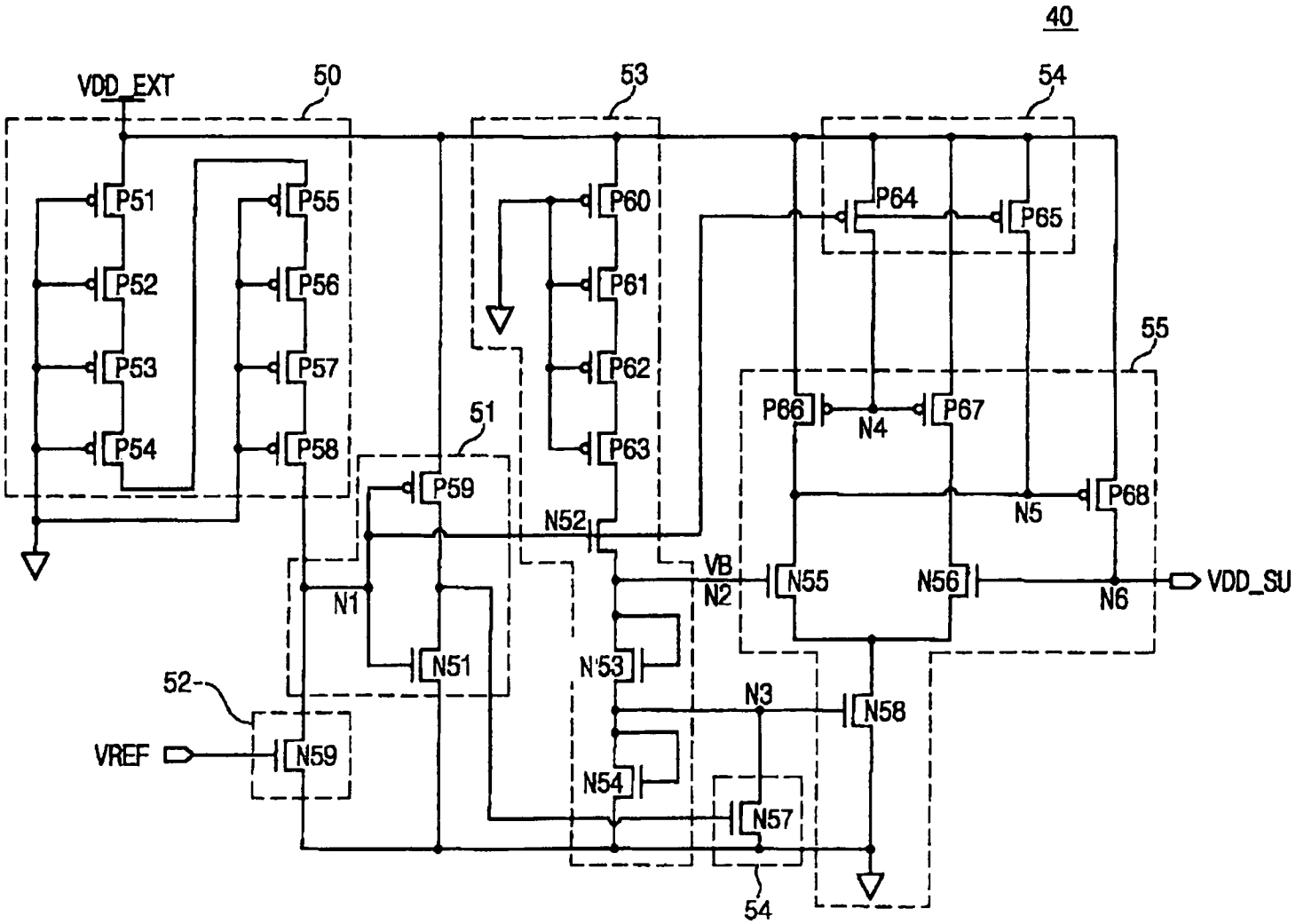
FIG. 5 is a circuit diagram illustrating the start-up voltage generating part shown in FIG. 4 in more detail.

FIG. 5 is a circuit diagram illustrating the start voltage generating part shown in FIG. 4 in more detail.

Referring to FIG. 5, a start-up voltage generating part 40 may include a resistor part 50, an input control part 51, a start-up reference voltage generating part 53, a start-up voltage output part 55, a switching part 54, and/or a feedback control part 52. The resistor part 50 may be connected to an external power supply voltage VDD_EXT. The input control part 51 may be used for determining whether a start-up voltage VDD_SU should be generated based on a level of the external power supply voltage VDD_EXT provided via the resistor part 50. The start-up reference voltage generating part 53 may be used for generating a start-up reference voltage VB for generation of the start-up voltage VDD_SU according to the control of the input control part 51. The start-up voltage output part 55 may be used for generating a start-up voltage VDD_SU regulated via a differential amplification structure using the start-up reference voltage VB. The switching part 54 may be used for controlling a switch operation of the start-up voltage output part 55 in response to the input control part 51. The feedback control part 52 may be used for controlling an on/off of the start-up voltage generating part 40 in response to a fed-back reference voltage VREF.

The resistor part 50 may include PMOS transistors P51 to P58 having long channels and connected in series each other. Although eight transistors P51 to P58 are illustrated in FIG. 5, the number of transistors may be adjusted based on the voltage level desired at node N1.

The feedback control part 52 may include an NMOS transistor N59, but may also be implemented using any type of a switch structure and a PMOS transistor.

The input control part 51 may include PMOS and NMOS transistors P59 and N51 connected to form an inverter. The start-up reference voltage generating part 53 may include PMOS transistors P60 to P63 having a long channel and connected in series each other, an NMOS transistor N52 having a gate controlled by the node N1, and diode-connected NMOS transistors N53 and N54 for determining a level of the start-up reference voltage VB at a node N2.

Although FIG. 5 illustrates a given number of transistors according to an example embodiment, the number of the PMOS transistors P60 to P63 and the number of the NMOS transistors N53 and N54 may be adjusted based on a voltage level of the start-up reference voltage VB.

An NMOS transistor N57 may control an NMOS transistor N58 of the start-up voltage output part 55 in response to an output of the input control part 51.

The start-up voltage output part 55 may include NMOS transistors N55 and N56 forming a differential input, PMOS transistors P66 and P67 forming a current mirror at an output stage, an NMOS transistor N58 connected to a ground voltage, and a PMOS transistor P68 for regulating an output start-up voltage VDD_SU.

The switching part 54 may control a switch operation of the start-up voltage output part 55 according to a voltage level of the node N1. A PMOS transistor P64 may control a node N4, and a PMOS transistor P65 may control a node N5. Further, an NMOS transistor N57 in the switching part 54 may be controlled according to a level of the input control part 51 and control a switch operation of the start-up voltage output part 55 as a regulator.

An operation of the start-up voltage generating part 40 is described in more detail below.

Because a reference voltage VREF may not be generated at an initial point of time when an external power supply voltage VDD_EXT is applied, an NMOS transistor N59 may be turned off and a node N1 may be maintained at a relatively high level, where a bias current may be supplied with respect to an overall circuit of the start-up voltage generating part 40. Accordingly, since transistors P64 and P65 of a switching part 54 may be turned off, a start-up voltage output part 55 may be maintained in an on state.

Since the node N1 may have a relatively high level, as described above, an NMOS transistor N52 may be turned on. An output of an input control part 51 receiving a voltage of the node N1 may be maintained at a low level, so that an NMOS transistor N57 may be turned off. As a result, a start-up reference voltage VB of a node N2 may have a voltage level corresponding to a sum of threshold voltages of transistors N53 and N54.

When a start-up reference voltage VB of the node N2 has a voltage level corresponding to a sum of threshold voltages of the transistors N53 and N54, an NMOS transistor N55 receiving the start-up reference voltage VB as an input of its gate terminal may be turned on.

When the NMOS transistor N55 is turned on, a current path may be formed via an NMOS transistor N58. A voltage level of a node N5 may be reduced toward a ground voltage based on formation of a current path, so that a PMOS transistor P68 may be turned on. A node N6 may be increased toward the external power supply voltage VDD_EXT, which may enable an NMOS transistor N56 to be turned on. When a voltage of the node N6 reaches the start-up reference voltage VB, a PMOS transistor P68 may be turned off. The voltage of the node N6, i.e. the start-up voltage VDD_SU, may be maintained the same as the start-up reference voltage VB through the above-described feedback scheme. Thus, a regulation operation may be performed by the PMOS transistor P68.

The node N2 may be connected to an inverting input terminal of a differential amplifier (P66, P67, N55, N56, N58), which may operate as a regulator together with the PMOS transistor P68. Accordingly, the start-up voltage VDD_SU may have a voltage level above the start-up reference voltage VB.

The start-up voltage VDD_SU may be used as an initial power supply voltage of the reference voltage generating part 41 to generate the reference voltage VREF.

If the reference voltage VREF is output from the reference voltage generating part 41, the NMOS transistor N59 in the feedback control part 52 may be turned on and the node N1 may have a relatively low level or ground voltage level. Accordingly, since the NMOS transistor N57 may be turned on and the node N3 may have a relatively low level or ground voltage level, the NMOS transistor N58 may be turned off.

Since the node N1 has a low level, the NMOS transistor N52 may be turned off, preventing the start-up reference voltage VB from being applied to the node N2. Further, since the PMOS transistors P64 and P65 may all be turned on, the nodes N4 and N5 may have a relatively high level where the regulator may not be operated.

Figure 6:
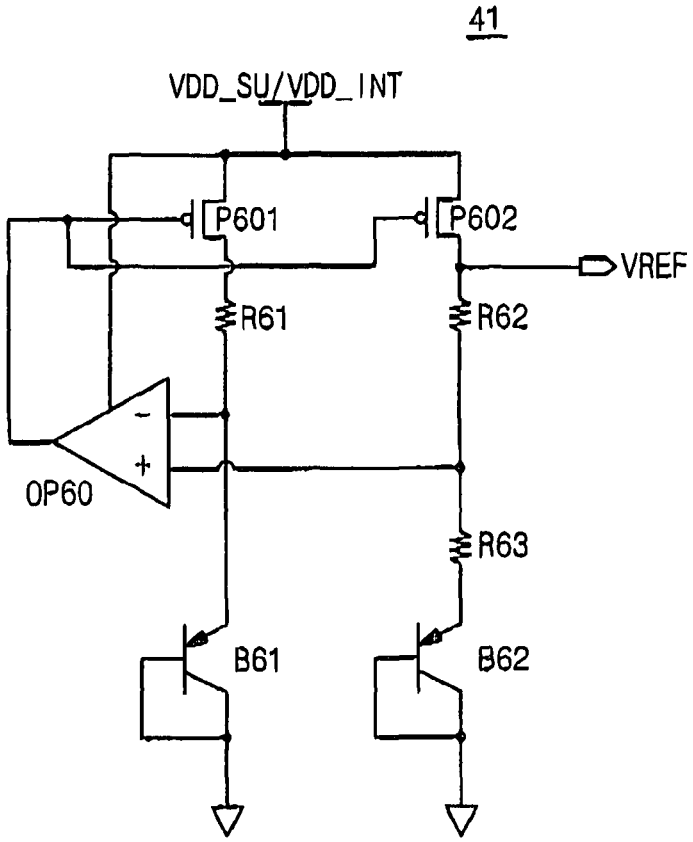
FIG. 6 is a circuit diagram illustrating the reference voltage generating part shown in FIG. 4 in more detail.

FIG. 6 is a circuit diagram illustrating the reference voltage generating part shown in FIG. 4 in more detail.

Referring to FIG. 6, the reference voltage generating part 41 may use a start-up voltage VDD_SU as its operating voltage at power-up and use an internal power supply voltage VDD_INT as its operating voltage during normal operation. The reference voltage generating part 41 in FIG. 6 may be a band gap type of a reference voltage circuit that is well known in the art, and description thereof will thus be omitted here.

At initial operation, when a start-up voltage VDD_SU is supplied, the reference voltage generating part 41 may generate a reference voltage VREF. An internal power supply voltage generating part 42 and a start-up voltage generating part 40 may operate in the above-described manner.

Figure 7:
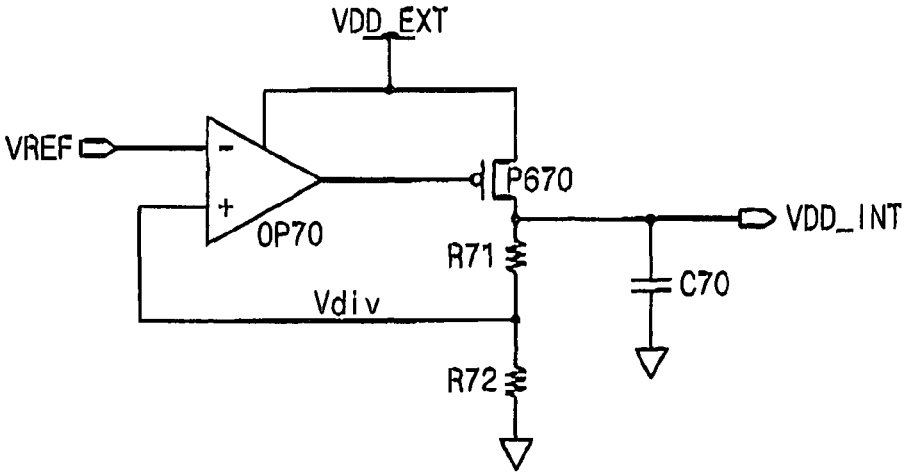
FIG. 7 is a circuit diagram illustrating the internal voltage generating part shown in FIG. 4 in more detail.

FIG. 7 is a circuit diagram illustrating the internal voltage generating part shown in FIG. 4 in more detail.

Referring to FIG. 7, a voltage Vdiv divided by resistors R71 and R72 may be applied to a non-inverting input terminal of a comparator OP70, and a reference voltage VREF may be applied to an inverting input terminal of the comparator OP70. The comparator OP70 may control a gate voltage of a PMOS transistor P670 in response to the input voltages Vdiv and VREF. If the divided voltage Vdiv is lower than the reference voltage VREF, the gate voltage of the PMOS transistor P670 may be lowered to allow a current flow from an external power supply voltage VDD_EXT to an internal power supply voltage VDD_INT. Accordingly, the internal power supply voltage VDD_INT may increase to a given voltage. Increase in the internal power supply voltage VDD_INT may follow an increase in the divided voltage Vdiv. However, if the divided voltage Vdiv is higher than the reference voltage VREF, the gate voltage of the PMOS transistor P670 may be increased to reduce or prevent the flow of current from the external power supply voltage VDD_EXT to the internal power supply voltage VDD_INT.

If the internal power supply voltage VDD_INT is decreased by current consumption in a semiconductor integrated circuit device, the gate voltage of the PMOS transistor P670 may be lowered via the comparator OP70. The internal power supply voltage VDD_INT may be maintained constantly via repetition of the above-described operation.

Figure 8:
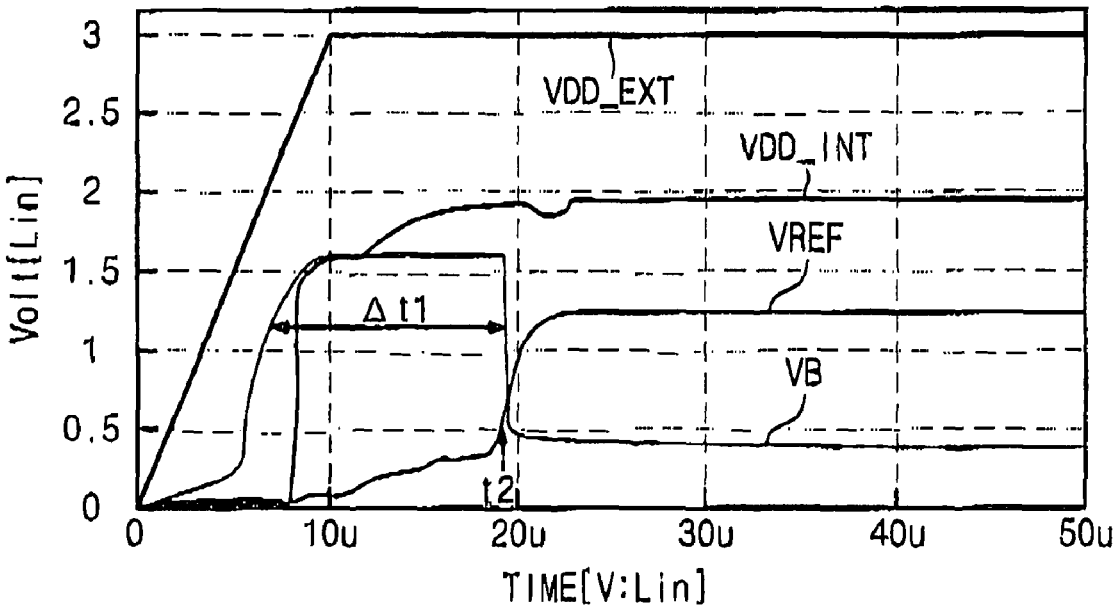
FIG. 8 is a timing diagram illustrating an operation of an internal power supply voltage generating device according to an example embodiment.

FIG. 8 is a timing diagram illustrating operation of an internal power supply voltage generating device according to an example embodiment.

Figure 3:
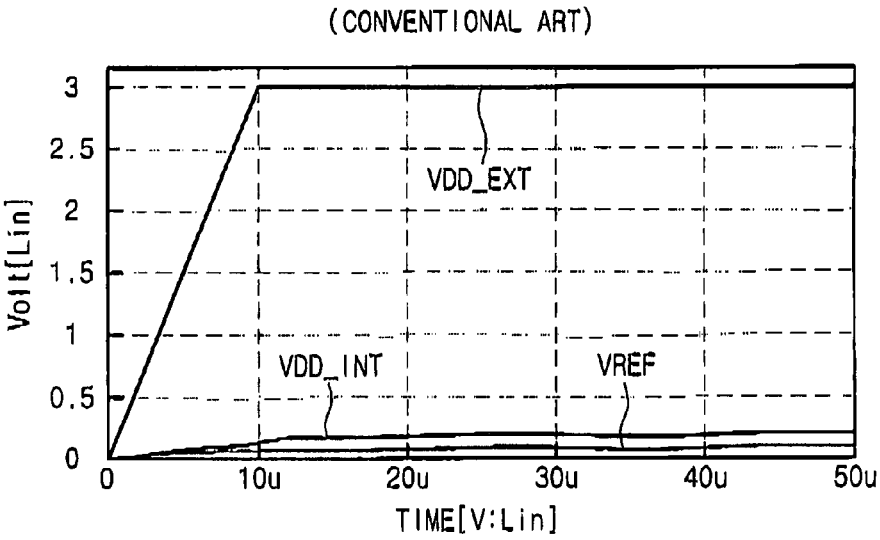
FIG. 3 is a timing diagram illustrating start-up of the internal power supply voltage generating device of FIG. 2.

Referring to FIG. 8, a reference voltage VREF and an internal power supply voltage VDD_INT, which are not generated normally in FIG. 3, may be generated according to an example embodiment. If an external power supply voltage is applied, a start-up voltage generating part 40 may operate during an initial time Δ t1. This may enable the start-up voltage generating part 40 to generate a start-up voltage VDD_SU above 2*Vth, where again Vth is a threshold voltage. The start-up voltage VDD_SU may be supplied to a reference voltage generating part 41. The reference voltage generating part 41 may operate normally and generate a reference voltage VREF from a point of time t2. The reference voltage VREF may be fed back to turn off the start-up voltage generating part 40. Afterward, a normal internal power supply voltage VDD_INT may be generated and maintained by the reference voltage VREF.

As set forth above, an internal power supply voltage generating device according to example embodiments may be configured to prevent variation of an internal power supply voltage VDD_INT due to variation of an external power supply voltage by using the internal power supply voltage VDD_INT as a driving voltage of a reference voltage generating part 41. Further, the internal power supply voltage generating device according to example embodiments may be configured to mitigate start-up delay difficulties of the reference voltage generating part 41 according to usage of the internal power supply voltage by providing a stable start-up voltage VDD_SU via a start-up voltage generating part 40.

Further, it may be possible to implement the internal power supply voltage generating device relatively simply without additional control logic by turning off the start-up voltage generating part 40 via feedback control of the start-up voltage generating part 40 when the reference voltage generating part 41 generates a reference voltage.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. An internal power supply voltage generating device, comprising:

a start-up voltage generating part configured to generate a start-up voltage using an external power supply voltage, the start-up voltage generating part including a differential amplifier structure supplied with a start-up reference voltage as a first input and the start-up voltage as a second input;

a reference voltage generating part configured to generate a reference voltage using the start-up voltage; and an internal power supply voltage generating part configured to generate an internal power supply voltage using the reference voltage and the external power supply voltage, wherein the start-up voltage generating part is turned off by the reference voltage generated by the reference voltage generating part.

2. The internal power supply voltage generating device of claim 1, wherein the reference voltage generating part generates the reference voltage in response to the start-up voltage during a start-up interval.

3. The internal power supply voltage generating device of claim 2, wherein the reference voltage generating part generates the reference voltage in response to the internal power supply voltage after the start-up interval.

4. The internal power supply voltage generating device of claim 1, wherein the start-up voltage generating part includes a feedback control part configured to turn off the start-up voltage generating part when the reference voltage is input.

5. The internal power supply voltage generating device of claim 4, wherein the start-up voltage generating part further includes:

an input control part connected to a first node between the external power supply voltage and the feedback control part;

a start-up reference voltage generating part controlled by the input control part and configured to generate the start-up reference voltage to supply the start-up reference voltage via a second node; and a start-up voltage output part having the differential amplifier structure, and configured to output the start-up voltage, the start-up voltage having a regulated voltage level between the start-up reference voltage and the internal power supply voltage.

6. The internal power supply voltage generating device of claim 5, wherein the start-up reference voltage has a voltage corresponding to a sum of threshold voltages of at least two transistors.

7. The internal power supply voltage generating device of claim 4, wherein the feedback control part includes a transistor receiving the reference voltage as a gate voltage.

8. The internal power supply voltage generating device of claim 7, wherein the start-up voltage generating part further includes:

an input control part connected to a first node between the external power supply voltage and the feedback control part;

a start-up reference voltage generating part controlled by the input control part and configured to generate the start-up reference voltage to supply the start-up reference voltage via a second node; and a start-up voltage output part having the differential amplifier structure, and configured to output the start-up voltage, the start-up voltage having a regulated voltage level between the start-up reference voltage and the internal power supply voltage.

9. The internal power supply voltage generating device of claim 8, wherein the start-up reference voltage has a voltage corresponding to a sum of threshold voltages of at least two transistors.

10. The internal power supply voltage generating device of claim 1, wherein the reference voltage generating part includes a band gap reference voltage generating circuit having a comparator.

11. A method of generating an internal power supply voltage, comprising:

generating a start-up voltage using an external power supply voltage;

supplying the start-up voltage and a start-up reference voltage to a differential amplifier structure;

generating a reference voltage using the start-up voltage;

generating an internal power supply voltage in response to the reference voltage and the external power supply voltage; and feeding back the reference voltage to stop generating the start-up voltage.

12. The method of claim 11, wherein generating the reference voltage is done during a start-up interval.

13. The method of claim 12, further comprising:

generating the reference voltage in response to the internal power supply voltage after the start-up interval.

14. The method of claim 11, wherein generating the start-up voltage includes:

generating the start-up reference voltage using the external power supply voltage; and generating the start-up voltage at a regulated voltage level between the start-up reference voltage and the internal power supply voltage.

15. The method of claim 14, wherein the start-up reference voltage has a voltage corresponding to a sum of threshold voltages of at least two transistors.

* * * * *